US005805133A

United States Patent [19]

Priem et al.

[11] Patent Number: 5,805,133

[45] Date of Patent: Sep. 8, 1998

[54] METHOD AND APPARATUS FOR INCREASING THE RATE OF SCROLLING IN A FRAME BUFFER SYSTEM DESIGNED FOR WINDOWING OPERATIONS

[75] Inventors: Curtis Priem, Fremont; Chris Malachowsky, Santa Clara; Rick Silverman, Cupertino; Shuen Chin Chang, San Jose, all of Calif.

[73] Assignees: Samsung Semiconductor, Inc., San Jose; Sun Microsystems, Inc., Mountain View, both of Calif.

[21] Appl. No.: 755,037

[22] Filed: Nov. 22, 1996

Related U.S. Application Data

[63] Continuation of Ser. No. 584,152, Jan. 11, 1996, abandoned, which is a continuation of Ser. No. 145,791, Oct. 29, 1993, abandoned.

[51] Int. Cl.[6] ..... G06G 5/34; G06G 5/00

[52] U.S. Cl. ..... 345/123; 345/507; 345/516

[58] Field of Search ..... 345/185, 196, 345/200, 203, 186, 123, 507, 516, 501; 395/162, 164, 166; 365/189.01, 189.02, 189.04, 189.12, 230.02, 230.03, 230.05, 230.06, 230.08

[56] References Cited

U.S. PATENT DOCUMENTS

| | | | |
|---|---|---|---|
| 4,099,258 | 7/1978 | Parsons | 345/185 |
| 4,648,077 | 3/1987 | Pinkham et al. | 365/189 |
| 4,752,893 | 6/1988 | Guttang et al. | 345/155 |
| 4,823,302 | 4/1989 | Christopher | 365/221 |
| 4,875,196 | 10/1989 | Spaderna et al. | 365/238 |
| 4,947,373 | 8/1990 | Yamaguchi et al. | 365/189.04 |
| 5,042,013 | 8/1991 | Sato | 365/230.05 |
| 5,093,805 | 3/1992 | Singh | 365/51 |
| 5,132,670 | 7/1992 | Miller | 345/186 |
| 5,170,157 | 12/1992 | Ishii | 340/799 |
| 5,249,159 | 9/1993 | Sato | 365/230.65 |
| 5,261,049 | 11/1993 | Lumelsky et al. | 345/186 |
| 5,282,177 | 1/1994 | McLaury | 365/230.05 |
| 5,305,278 | 4/1994 | Inoue | 365/230.03 |
| 5,319,606 | 6/1994 | Bowen et al. | 365/230.06 |
| 5,442,748 | 8/1995 | Chang et al. | 395/164 |
| 5,504,855 | 4/1996 | Priem et al. | 395/164 |
| 5,528,751 | 6/1996 | Priem et al. | 345/185 |
| 5,533,187 | 7/1996 | Priem et al. | 395/164 |
| 5,539,430 | 7/1996 | Priem et al. | 345/185 |

FOREIGN PATENT DOCUMENTS

| | | |
|---|---|---|
| 0225 197 | 6/1987 | European Pat. Off. . |
| 2180729 | 4/1987 | United Kingdom . |

*Primary Examiner*—Amare Mengistu

*Attorney, Agent, or Firm*—Blakely Sokoloff Taylor & Zatman

[57] ABSTRACT

A frame buffer including a memory array, circuitry for accessing the array, a plurality of latches each capable of storing a plurality of pixel values equivalent to a large portion of a row of pixels in the array which may be read simultaneously from the array, and circuitry for writing simultaneously to the memory cells of a row of the array the data stored in the latches whereby a row of pixels may be read and written back to the array bus in a minimum time period.

18 Claims, 7 Drawing Sheets

METHOD AND APPARATUS FOR INCREASING THE RATE OF SCROLLING IN A FRAME BUFFER SYSTEM DESIGNED FOR WINDOWING OPERATIONS

This is a continuation of application Ser. No. 08/584,152 filed Jan. 11, 1996 now abandoned, which is a continuation of application Ser. No. 08/145,791 filed Oct. 29, 1993, now abandoned.

BACKGROUND OF THE INVENTION

1. Field of the Invention

This invention relates to computer systems and, more particularly, to methods and apparatus for providing very fast modes of writing pixel data from one row to another in a frame buffer which stores data for display on an output display device.

2. History of the Prior Art

One of the significant problems involved in increasing the speed of operation of desktop computers has been in finding ways to increase the rate at which information is transferred to an output display device. Many of the various forms of data presentation which are presently available require that copious amounts of data be transferred. For example, if a computer output display monitor is operating in a color mode in which 1024×780 pixels are displayed on the screen and the mode is one in which thirty-two bits are used to define each pixel, then a total of over twenty-five millions bits of information must be transferred to the screen with each frame that is displayed. Typically, sixty frames are displayed each second so that over one and one-half billion bits must be transferred each second. This requires a very substantial amount of processing power and, in general, slows the overall operation of the computer.

In order to speed the process of transferring data to the display, various accelerating circuitry has been devised. In general, this accelerating circuitry (often referred to as a graphic rendering device) is adapted to relieve the central processor of the computer of the need to accomplish many of the functions necessary to transfer data to the display. Essentially, these accelerators take over various operations which the central processor would normally be required to accomplish. For example, block transfers of data from one position on the screen to another require that each line of data on the screen being transferred be read and rewritten to a new position on a new line. Storing information within window areas of a display requires that the data available for each window portion be clipped to fit within that window portion and not overwrite other portions of the display. Many other functions require the generation of various vectors when an image within a window on the display is moved or somehow manipulated. When accomplished by a central processing unit, all of these operations require a substantial portion of the time available to the central processing unit. These repetitive sorts of functions may be accomplished by a graphics accelerator and relieve the central processor of the burden. In general, it has been found that if operations which handle a great number of pixels at once are mechanized by a graphics accelerator, then the greatest increase in display speed may be attained.

A problem which has been discovered by designers of graphics accelerator circuitry is that a great deal of the speed improvement which is accomplished by the graphics accelerator circuitry is negated by the frame buffer circuitry into which the output of the graphics accelerator is loaded for ultimate display on an output display device. Typically, a frame buffer offers a sufficient amount of dynamic random access memory (DRAM) to store one frame of data to be displayed. However, transferring the data to and from the frame buffer is very slow because of the manner in which the frame buffers are constructed. Various improvements have been made to speed access in frame buffers. For example, two-ported video random access memory (VRAM) has been substituted for dynamic random access memory (DRAM) so that information may be taken from the frame buffer at the same time that other information is being loaded into the frame buffer.

One of the slowest operations performed is the scrolling of data. In a scrolling operation rows of data are moved up or down on the output display. Since the data describing the pixels which are displayed on an output display device is stored in a frame buffer, scrolling requires that the pixel data in the frame buffer describing a row of the display be read from the frame buffer by the central processor and written back to another position in the frame buffer. In a typical personal computer, thirty-two bits of data (one pixel in thirty-two bit color or four pixels is eight bit color) are read from the frame buffer simultaneously in an operation that typically requires 120 nanoseconds. This is followed by an access to write the data back to the appropriate positions in the frame buffer which again requires 120 nanoseconds. The total time per bit is thus approximately 7.5 ns./bit transferred. This pattern of reading and writing is continued until an entire row has been read and rewritten. Since a typical screen holds rows of 1024 pixels, 240 nanoseconds times 1024 pixels is required to scroll a single row of thirty-two bit color pixels on the display or one-fourth that time for eight bit pixels. Each line of text takes up approximately twelve rows of pixels so scrolling a line of text takes a very long time. Using the latest and most advanced rendering accelerators, it is possible to scroll approximately three times as fast as this. It is very desirable that frame buffers be provided which allow more rapid scrolling than that presently available.

SUMMARY OF THE INVENTION

It is, therefore, an object of the present invention to provide a new design of frame buffer capable of speeding the display of data by factors which are orders of magnitude of the speed of prior art frame buffers.

It is another more specific object of the present invention to provide a new design of frame buffer capable of rapidly scrolling large blocks of data.

These and other objects of the present invention are realized in a frame buffer including a memory array, circuitry for accessing the array, a plurality of latches each capable of storing a plurality of pixel values equivalent to a large portion of a row of pixels in the array which may be read simultaneously from the array, and circuitry for writing simultaneously to the memory cells of a row of the array the data stored in the latches whereby a row of pixels may be read and written back to the array bus in a minimum time period.

These and other objects and features of the invention will be better understood by reference to the detailed description which follows taken together with the drawings in which like elements are referred to by like designations throughout the several views.

Notation And Nomenclature

Some portions of the detailed descriptions which follow are presented in terms of symbolic representations of operations on data bits within a computer memory. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to apparatus for operating a computer in processing electrical or other (e.g. mechanical, chemical) physical signals to generate other desired physical signals.

DETAILED DESCRIPTION OF THE INVENTION

Figure 1:
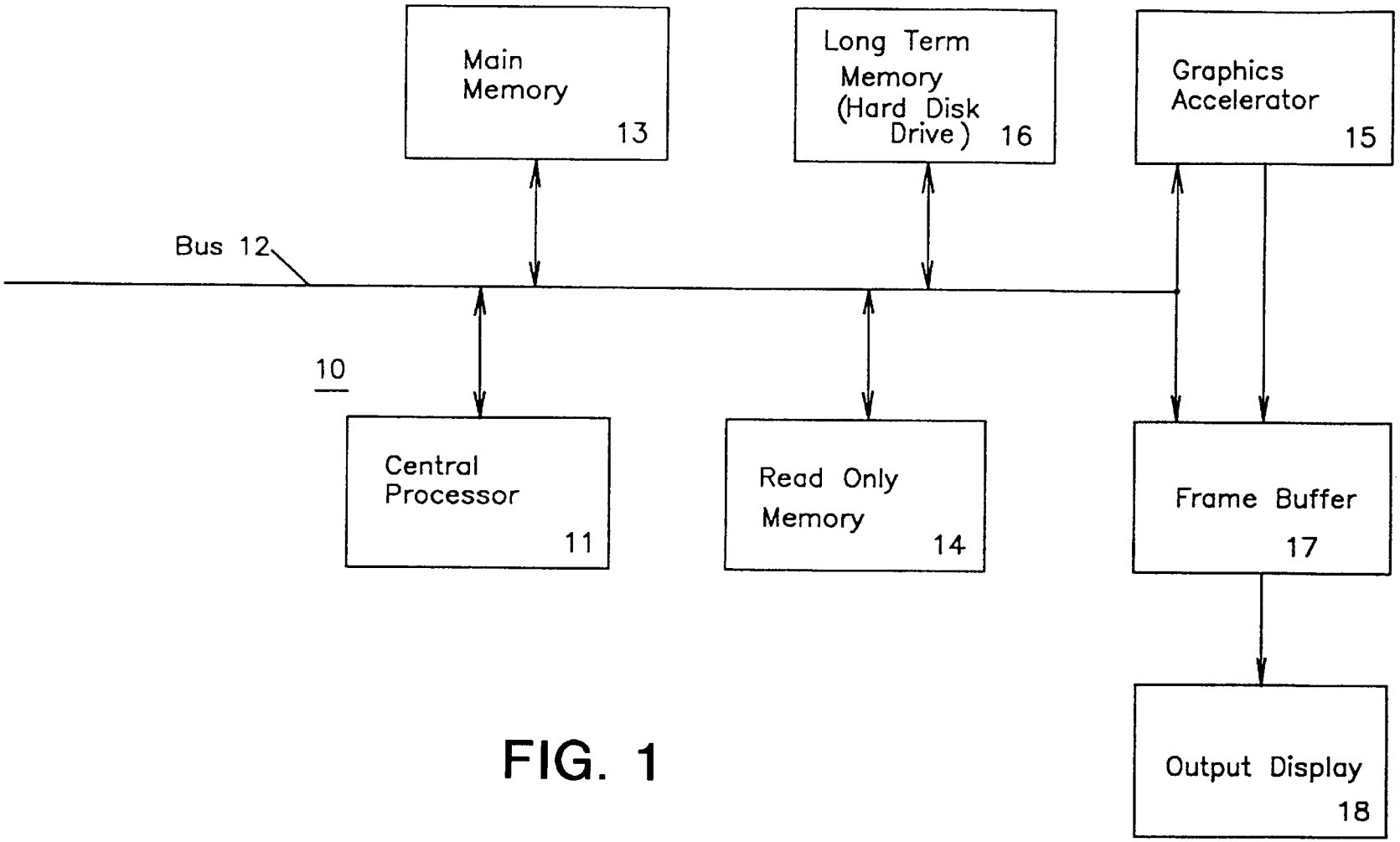
FIG. 1 is a block diagram illustrating a computer system which may include the present invention.

Referring now to FIG. 1, there is illustrated a computer system 10. The system 10 includes a central processor 11 which carries out the various instructions provided to the computer 10 for its operations. The central processor 11 is joined to a bus 12 adapted to carry information to various components of the system 10. Also connected to the bus 12 is main memory 13 which is typically constructed of dynamic random access memory arranged in a manner well known to those skilled in the prior art to store information being used by the central processor during the period in which power is provided to the system 10. A read only memory 14 which may include various memory devices (such as electrically programmable read only memory devices (EPROM devices)) well known to those skilled in the art which are adapted to retain a memory condition in the absence of power to the system 10. The read only memory 14 typically stores various basic functions used by the processor 11 such as basic input/output and startup processes.

Also connected to the bus 12 are various peripheral components such as long term memory 16. The construction and operation of long term memory 16 (typically electromechanical hard disk drives) are well known to those skilled in the art. A frame buffer 17 is also coupled to the bus 12. The frame buffer 17 stores data which is to be transferred to an output device such as a monitor 18 to define pixel positions on the output device. For the purposes of the present explanation, the frame buffer 17 may be considered to include in addition to various memory planes necessary to store information, various circuitry well known to those skilled in the art for controlling the scan of information to the output display. In addition, the frame buffer 17 may be connected to the bus 12 through circuitry such as graphic accelerating circuit 15 used for providing fast rendering of graphical data to be furnished to the frame buffer 17.

Figure 2:
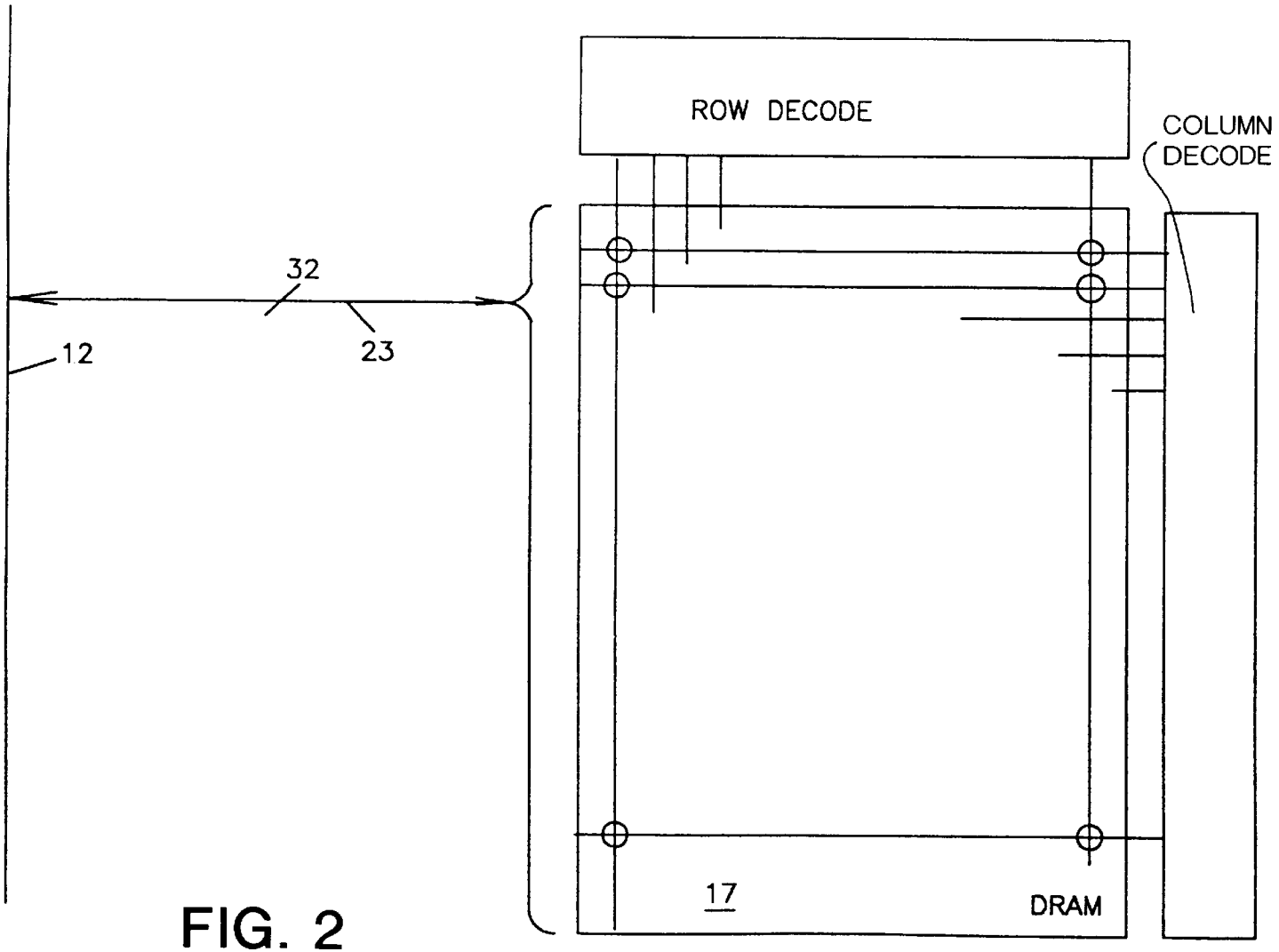
FIG. 2 is a block diagram illustrating a frame buffer designed in accordance with the prior art.

FIG. 2 illustrates a frame buffer 17 constructed in accordance with the prior art. Typically such a frame buffer includes a dynamic random access memory array designed to store the information defining pixels on the output display. As outlined above, when a random access memory used as a frame buffer 17 is accessed in its normal mode of operation, data is written to or read from the frame buffer 17 on data conductors 23 connected to the conductors of the data bus 12 by the device controlling the operation, the central processing unit or the graphics accelerator. When the frame buffer 17 is written in this normal mode, all of the data conductors 23 transfer binary data. In a typical computer system having a thirty-two bit bus, thirty-two bits of data may be written on the bus and appear at thirty-two data input pins to the frame buffer memory. This data may define one or more pixels depending upon the number of bits required to define a pixel in the particular color mode of operation. For example, if the mode of operation is eight bit color, then each pixel displayed requires eight bits of data; and thirty-two bits of data on the data conductors are capable of defining four pixels in each access. This normal mode is a relatively slow method of filling the frame buffer with data to be written to the display. This is, however, the typical method of writing to and reading from a frame buffer.

There are many operations which affect the display, however, which manipulate very large numbers of pixels. One of these operation is the scrolling operation in which data on the screen is moved up or down, line by line. This is typically a very slow operation because of the amount of data which must be moved in order to accomplish the operation and because the operation affects at most four pixels at once (in eight bit color mode). When the frame buffer 17 is read in a typical scrolling operation, a number of memory devices equal to the number of data conductors on the data bus are typically read to provide data for from one (thirty-two bit color) to four (eight bit color) pixels. This information is placed on the data bus and is sent to the device controlling the scrolling operation, typically the central processing unit. Once the controlling device has read the data, it then rewrites the data to the new address (the new row) in the frame buffer 17 using the data conductors 23. The number of pixels which may be read at one time is equal to the number of data conductors on the data bus divided by the size of the pixel; with a thirty-two bit bus, for eight bit color pixels, four pixels are read at once and then written back to its new position, while with thirty-two bit color pixels only one pixel is read and written back to its new position with each access.

Figure 3A:
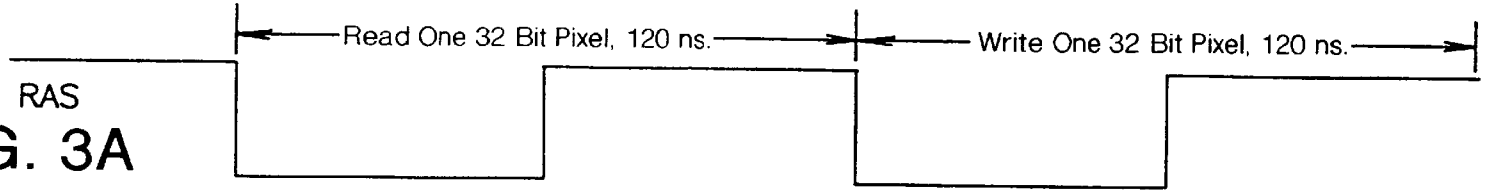
FIG. 3 is a timing diagram illustrating the operation of the prior art frame buffer of FIG. 2.
Figure 3B:
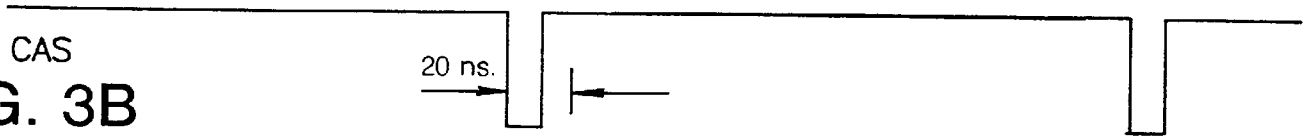

FIG. 3 is a timing diagram illustrating certain of the signals necessary to each of these read and write operations. Shown are the row access strobe (RAS) signals and the column access strobe (CAS) signals which are used to time the operations. The RAS signal initiates the row selection while the CAS signal initiates the column selection and signals the time at which data is sampled in prior art frame buffers. Since each read and each write access requires both a RAS signal and a CAS signal, to both read and write the number of bits carried by the data conductors on the bus in one operation requires approximately 240 ns. in state of the art prior art systems. Thus, to read the pixels of a single row of the frame buffer and rewrite those pixels to a new row where the pixels are stored in thirty-two bit color mode requires 240 nanoseconds multiplied by the number of pixels in a row (typically 512 or 1024). Since each line of text and the space to the next line occupies approximately twelve rows of a display, moving a single line of text requires 240×1024×12 nanoseconds in thirty-two bit color mode with a display in which a row is 1024 pixels wide.

Figure 4:
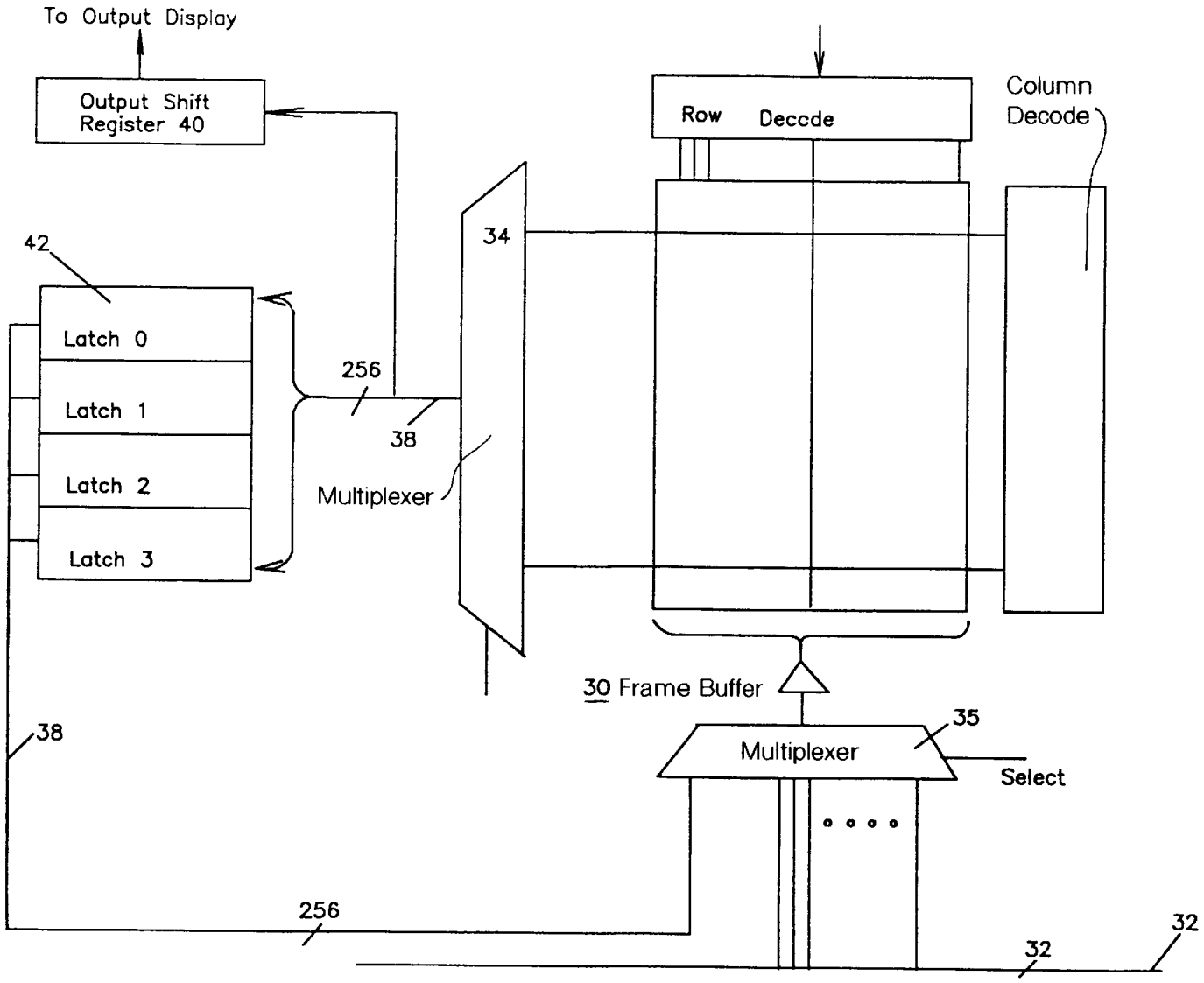
FIG. 4 is a block diagram illustrating the basic arrangement of the invention.
Figure 8:
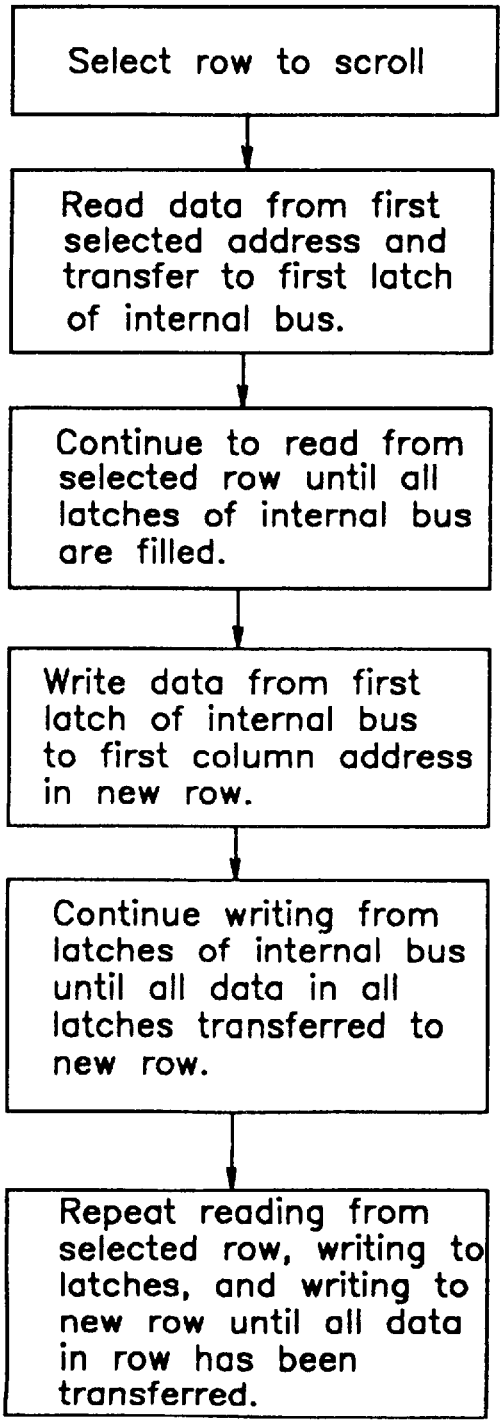
FIG. 8 is a flow chart describing a method in accordance with the present invention.

FIG. 4 illustrates a frame buffer 30 constructed in accordance with the present invention which may be used to drastically accelerate the speed by which scrolling may be accomplished. A flow chart outlining the process of scrolling is illustrated in FIG. 8. The frame buffer 30 is connected to a plurality of data input conductors 32. Data is transferred to the frame buffer 30 on the data conductors 32 from a data bus which is not illustrated in detail but typically includes thirty-two individual data conductors. A multiplexor 35 selects the data on the data conductors 32 for transfer to the array of the frame buffer when data provided by the central processor or by a graphics accelerator is to be written.

Figure 5A:
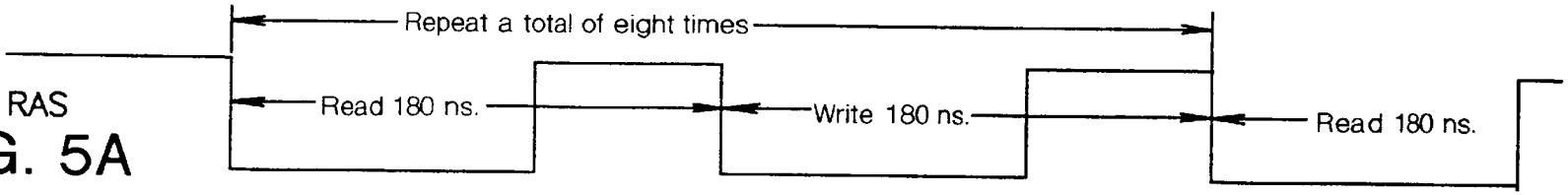
FIG. 5 is a timing diagram illustrating the operation of the frame buffer of FIG. 4.
Figure 5B:
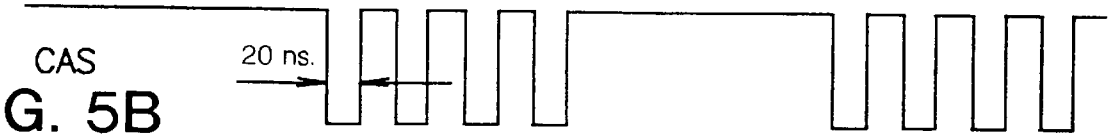

Data is read from the frame buffer 30 for transfer to the output display on an internal data bus 38 which in one embodiment may be wide enough to handle 32 pixels of eight bit color data. Data on the internal data bus 38 may be transferred to an output register 40 from which the pixel data may be transferred serially to circuitry for driving an output display device (not shown in FIG. 3). Data on the internal data bus 38 may also be transferred to a series of four internal data latches 42 (individually designated latches 0–3). Each of the data latches 42 is constructed in a manner well known to those skilled in the art and is capable of storing 32 pixels of eight bit color data. As will be seen, the four latches 42 are thus sufficient to hold a total number of pixels equal to 128 pixels read from the frame buffer. Using this arrangement, reading data from a row of the frame buffer may be accomplished 32 pixels at a time. Consequently, as is illustrated in FIG. 5, only one individual RAS and four CAS operations are necessary to read a total of 128 pixels from the frame buffer to the latches rather than one RAS/CAS operation for each pixel. With a display in which a row of pixels includes 1024 individual eight bit pixels, this is approximately 85 times as fast as using the prior art scrolling technique.

Figure 6:
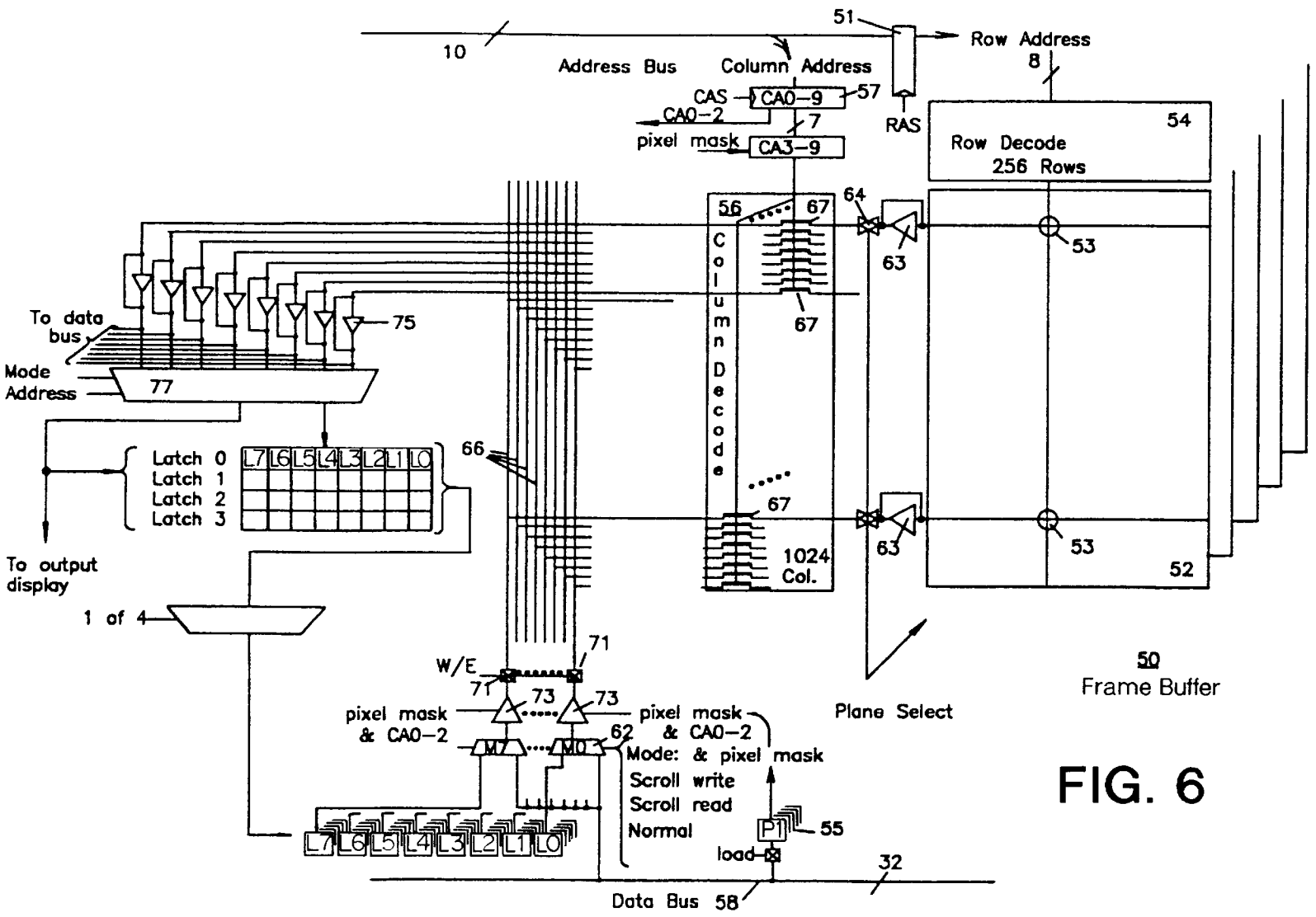
FIG. 6 is a more detailed block diagram of the circuitry of FIG. 4 which may be used to carry out the present invention.

In a similar manner, since the data is immediately available in the latches stored on the frame buffer and need not be taken off the chip, writing the latches 42 back to the frame buffer is done in 32 pixel groups through the selection offered by the multiplexor 35. The new location to which the data is to be written is addressed on the address bus using one RAS and four CAS cycles in order to address the four sequential groups of columns necessary to write the data stored in the four latches. Thus, this operation (like the read operation) also requires only one RAS and four CAS cycles (as is illustrated in FIG. 5). Thus, the total time required to scroll a row of pixels is approximately 180 ns. multiplied by eight with a 1024 pixel wide display. As may be seen, this entire operation is also approximately 85 times as fast as scrolling is accomplished in prior art frame buffers. As will be appreciated, the read, latch, write sequence provides what is essentially a very wide internal bus for accomplishing the scrolling operation Referring now to FIG. 6, there is illustrated a more specific block diagram useful in understanding the invention. FIG. 6 illustrates a circuit which includes the various components of a frame buffer 50. The frame buffer 50 includes a plurality of memory devices 53 such as field effect transistor devices arranged to provide dynamic random access memory array 52. The arrangement of the devices 53 constituting the array 52 is developed in accordance with principals well known to those skilled in the art. It is adapted to provide in the array 52 of the frame buffer 50 a sufficient number of addressable memory devices 53 to describe the number of pixels to be presented on an output display device in a particular mode of operation. For example, the array 52 may include a total of thirty-two planes (only the first is illustrated in detail in FIG. 6), each plane including 256 rows, each row including 1024 memory devices; such an arrangement would allow the storage of color data sufficient to display thirty-two bit color in a 512×512 pixel display on a color output display terminal.

In addition to the array 52, the frame buffer 50 includes row and column decode circuitry for decoding the addresses furnished by a controller such as a central processor and selecting individual memory cells in each plane of the array 52 to define the various pixels which may be represented on an output display device. The address decoding circuitry includes row decoding circuitry 54 and column decoding circuitry 56 by which individual memory devices representing individual pixels may be selected for reading and writing. Also included as a part of the frame buffer 50 are data conductors 58 which may be connected to a data bus to provide data to be utilized in the array 52. Typically, thirty-two data conductors 58 are provided although this number will vary with the particular computer system. The number thirty-two matches the number of bits which are transferred to indicate the color of a single pixel of the largest number of bits expected to be used by the display system in the most accurate color mode of operation.

When data is written to the frame buffer 50 on the data bus in the normal mode of operation, each group of thirty-two bits will define one or more color values to be displayed at one or more pixel positions on the output display. Thus, when an output display is displaying data in an eight bit color mode, the thirty-two bits carried by the data conductors 58 may define four pixel positions on the display in normal write mode. On the other hand, when a display is displaying data in a thirty-two bit color mode, the thirty-two bits of the data conductors 58 carry information defining a single pixel position on the display. As may be seen, one of the data conductors 58 of the bus is connected to all of eight multiplexors 62 in each plane of the array so that the data bit carried by that conductor 58 may be placed in the appropriate memory cell of the plane of the array 52. Each of the multiplexors 62 selects the source of the data to be transferred to the array 52 in each plane depending on the mode of operation selected. Thus, if the mode is normal, then the data bit is selected directly from the data conductor 58 for that plane of the array. The bit is transferred to the particular column selected and written to that column and the selected row. Since a bit may be written in each of thirty-two planes of the array, thirty-two bits may be written from the bus conductors 58 (one to each plane) as one thirty-two bit pixel, two sixteen bit pixels, or four eight bit pixels, depending on the mode of color operation.

The embodiment illustrated in FIG. 6 is the preferred embodiment of the invention which is particularly adapted to be used in a system utilizing eight bit color modes. As will be seen, the system is adapted to function with eight bit color modes of operation. To this end, the system utilizes eight individual multiplexors 62 in each plane of the frame buffer 50 for selecting particular write input data. Each of these multiplexors 62 has its output connected to one of eight tri-state write drivers 73 which furnishes an output signal via a write enable switch such as a transmission gate 71 on a conductor connected to every eighth column of the particular plane of the array.

In a normal mode write operation, a particular address is transferred on the address bus to select a particular row and column. The row address is furnished to the row decode circuitry 54 on the falling edge of a row address strobe signal (which typically requires 120 ns.) which is furnished to enable a row address latch 51. The row address causes power to be furnished to all of the memory devices 53 joined to the particular row of the array. Once power has been furnished to the appropriate row of the array, the value of each memory cell in the row is sensed by a sense amplifier 63 for each column of the array. The sense amplifiers 63 are turned on, and the value on the memory device sensed by each sense amplifier 63 is driven back to refresh the memory device 53.

At the falling edge of the CAS signal, the column address applied to the appropriate switch 67 of the column decode circuitry 56 selects the appropriate column in each plane to be written. In the preferred embodiment of the invention, the column address is ten bits. These ten bits are transferred to a latch 57 which is enabled by the CAS signal. Of these ten bits, the higher valued seven bits CA3–9 of the ten bit column address are used to select a group of eight adjacent columns. The normal mode write control signal at each of the multiplexors 62 causes the data signal on the single conductor 58 associated with that plane to be transferred by each of the eight multiplexors 62. One of the signals produced by the multiplexors 62 is amplified by a single one of the amplifiers 73 and transferred to the addressed memory cell 53 in that plane of the array. The lower three bits CA0–2 of the column address signal from the latch 57 select the particular one of the amplifiers 73 which transfers the data bit to a single one of the columns. Since each of the conductors 58 associated with each plane of the array 52 carries an individual bit for the memory cell at the selected row and column, the pixel value (or values) will be transferred to the appropriate column and row position in each plane of the array.

In a similar manner, when a particular pixel value is to be read in the normal mode of operation, the row and column address is transferred to the decode circuitry 54 and 56. A row address is selected on the falling edge of the RAS signal; and the entire row of memory cells in each selected plane of the array 52 is refreshed. At the falling edge of the CAS signal, the higher valued seven bits CA3–9 of the column address are applied to the appropriate switches 67 of the column decode circuitry 56 to select the eight adjacent columns in each plane which have been addressed and are to be read. The condition of the memory cells 53 in each of these eight columns of each selected plane are sensed by a second set of output sense amplifiers 75. The output of a particular one of the columns is selected by a array of transmission gates 77 in each plane which is controlled by the normal mode read signal and the value of the lower three bits CA0–2 of the column address. This causes the condition of a particular memory cell 53 to be transferred to a particular one of the conductors 58 of the data bus associated with that plane of the array 52.

As has been described above in general, a rapid scrolling operation may be accomplished by the present invention. In the scrolling operation, the data is first read and then written back to the array to a new row. In order to accomplish this, a scroll mode signal is initiated by the controlling circuitry; and an address is furnished to the row and column decode circuitry to designate the particular data to be scrolled. The scroll mode causes a particular row to be selected at the falling edge of a RAS signal as in normal mode of operation and the memory cells of that row to be refreshed. The higher order bits of the column address are used to select the eight adjacent columns of the address. The scroll mode signal at the array of transmission gates 77 of each plane causes the data in the memory cells of each of the eight columns selected to be transferred to a first eight bit latch shown as latch 0 in the figure. A next sequential address causes the data in the memory cells of each of the next eight columns to be selected and to be transferred to a second eight bit latch shown as latch 1 in the figure. This continues for two more read operations which select two more sets of eight memory cells in each plane and place the results read in third and fourth eight bit latches latch 2 and latch 3.

Thus, in a set of four read operations taking only 180 ns, a total of thirty-two bits in each of thirty-two planes is read and stored in the Latches 0–3. This means that in eight read accesses each requiring a single RAS signal and four CAS signal, a total of 1024 eight bit pixels, or an entire row of pixels on a display 1024 pixels wide, may be stored in the latches 0–3. Thus, a total of 1024 pixels may be accessed and stored in a total period of 1440 ns.

As is shown in FIG. 6, each latch 0–3 is connected so that its individual bits may be selected by a multiplexor 79 to be furnished to the multiplexors 62. In the figure, one of the latches 0–3 is illustrated with each of its bit positions furnishing input to each of the eight individual multiplexors 62 of that memory plane. This allows four sequential write operations to four consecutive addresses, each operation requiring one RAS and four CAS signals and taking a total of approximately 180 ns., to write the data in the four latches being scrolled back to the new row positions in the array 52 to which the row is addressed. As with the scroll read operation, the scroll mode control signal causes the higher bits of the column address to select the appropriate eight adjacent columns in each write operation. The scroll mode control signal then selects all of the columns using the drivers 73 and the write enable switches 71. In each write back operation used in scrolling, the values in each of the individual bit latches 0-3 are then driven onto the array by overdriving the sense amplifiers 63 to establish the new values at the selected memory positions in the appropriate cells of the array. Thus, the total time required to read and write back the data to scroll the row is only 2880 ns., approximately one-85th of that required to scroll in prior art arrangements.

Thus, it may be seen that the arrangement of the present invention provides very rapid scrolling operations in a frame buffer.

An additional facility of the invention allows it to clip pixel data to fit windows in which that data is stored at the same time that scrolling is taking place. It will have been noted that during any period in which scrolling is occurring, the conductors 58 on the data bus are not being used for the scrolling. By sending enabling signals on the data conductors 58 to the write enable gates 71 of each array, clipping may be accomplished. For example, if a first data conductor 58 carries a zero indicating that a write is not to occur and that signal is applied to disable the transmission gates 71 connected to all of the conductors 66 (one in each plane of the array 52) affecting a particular pixel, then the bits in the particular latch bit position will not be written. Thus an entire pixel may be clipped. If all of the data conductors controlling pixel positions outside a window carry zero values, then the entire area outside a window may be clipped while the scrolling is occurring.

Figure 7:
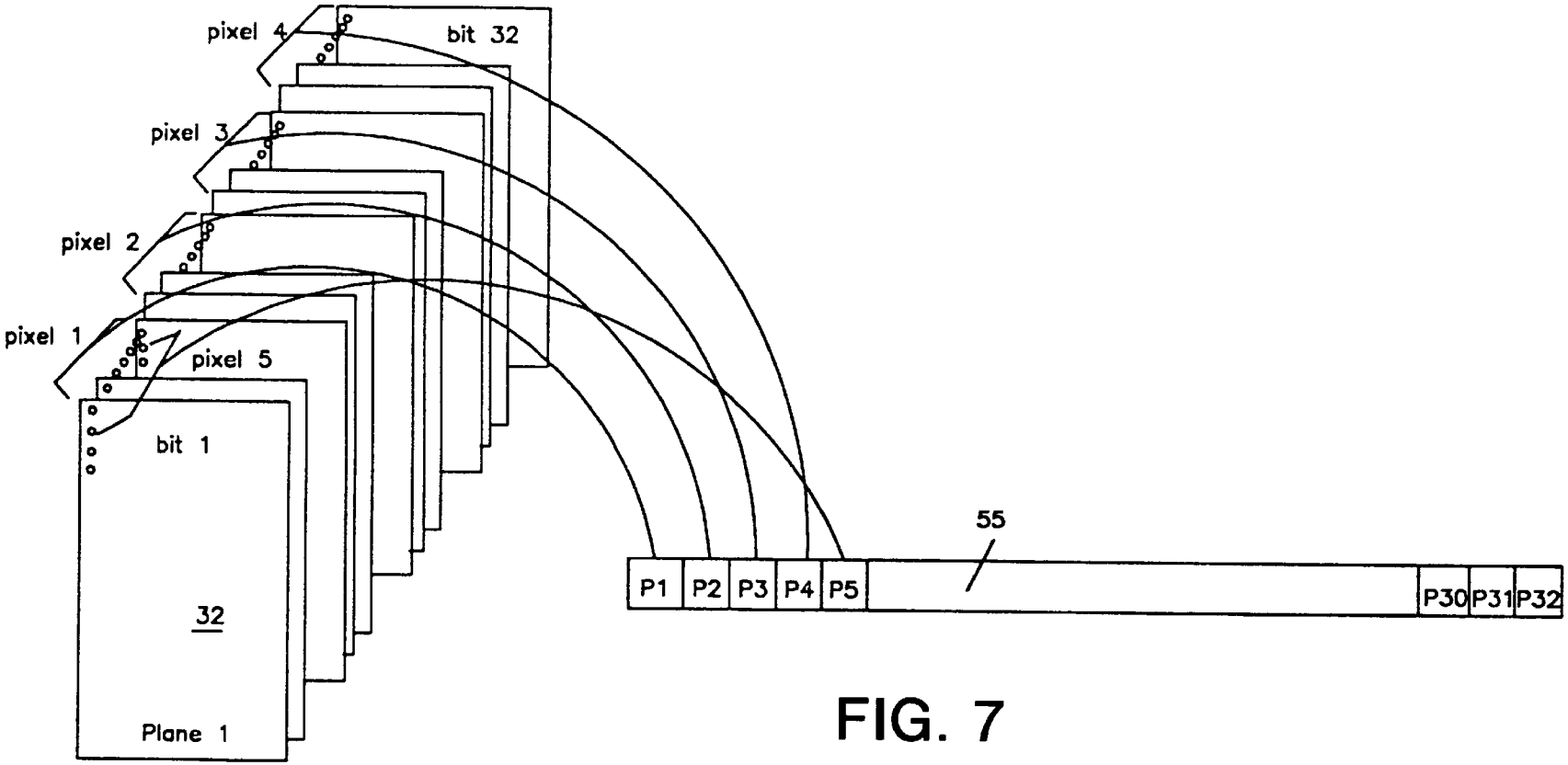
FIG. 7 is a diagram useful in understanding FIG. 6.

FIG. 7 illustrates how this may be accomplished. The control signal data appearing on the conductors 58 used for clipping is sent to a pixel mask register 55 (also shown in FIG. 6). The pixel mask register 55 is used to control all of the drivers 73 controlling transfer of data to a particular pixel. The example here considered involves eight bit pixels and assumes that the first eight columns have been selected by the high order bits of the column address. In such a case, the bits defining the first pixel lie in the first column in the selected row and the first eight planes of that column. The first pixel P1 in the pixel mask register 55 controls the drivers 73 to transfer or not transfer the values in the latches 0–3 to the particular pixel position. Presuming that the second one of the conductors 58 carries a zero value and that this value is stored in the pixel mask register 55, the drivers 73 connected to the bit positions lying in the next eight planes of column 0 are disabled so that the value in the latches are not transferred to these bit positions. The control of the other bit positions occurs in a similar manner as is illustrated in FIG. 7 In this manner, the present invention may accomplish clipping of a row of data during the scrolling of that data to a new position.

The data appearing on the conductors 38 is sent to a pixel mask register 55. The pixel mask register is used to control all of the drivers 53 controlling transfer of data to a particular pixel. The manner in which this is accomplished is illustrated in FIG. 5. Since the example considered involves eight bit color and assuming that the first eight columns have been selected by the column address, the bits defining the first pixel lie in the first column in the selected row and the first eight planes of that column. The first pixel P1 in the pixel mask register 55 controls the drivers 53 to transfer the color to these bit positions in the array from the color value register C0. Presuming that the second one of the conductors 38 carries a zero value and that this value is stored in the pixel mask register 55, the drivers 53 connected to the bit positions lying in the next eight planes of column 0 are disabled so that the value in the color value register C0 is not transferred to these bit positions. The control of the other bit positions occurs in a similar manner as is illustrated in FIG. 5. Consequently, with one row and eight columns selected, a number of pixels selected by one values on the data conductors 38 up to a total of thirty-two eight bit color pixels may be written simultaneously with the value stored in the color value register C0.

Another facility of the present invention for scrolling rows of pixel data allows the data in a row to be shifted while scrolling. As may be seen, since each of the bits stored in any latch 0–3 may be furnished to every eighth column simply by changing the column address to which the bit is written back in the array 52, data may be shifted in increments of thirty-two pixels to the right or left in a row simply by modifying the address to which the data is written back.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A frame buffer comprising:

a memory array including a plurality of rows and columns of memory cells;

circuitry for accessing the array;

latching circuitry for storing data defining a plurality of pixel values;

circuitry for simultaneously reading in parallel, from the array, data defining a portion of a row of pixels and for storing the data in the latching circuitry, said portion of a row corresponding to a predetermined number of adjacent columns of the memory array;

circuitry for writing data stored in the latching circuitry to the memory cells of a row of the array, said circuitry for writing including a plurality of driving devices for writing data to columns of the array; and a pixel masking storage device storing a pixel mask value simultaneously with a scrolling of data wherein a predetermined pixel mask value causes said pixel masking storage device to cause a corresponding driving device of said plurality of driving devices to be disabled such that clipping of a row of data is accomplished during the scrolling of said data.

2. The frame buffer of claim 1 wherein the latching circuitry includes at least one latch for storing data defining pixels in a portion of a row of a display, and the circuitry for simultaneously reading in parallel, from the array, data defining a portion of a row of pixels and for storing the data in the latching circuitry includes:

circuitry for simultaneously reading data in parallel from a plurality of columns of a memory array, and;

circuitry for writing data read simultaneously to the at least one latch.

3. The frame buffer of claim 1 wherein the circuitry for writing the data stored in the latching circuitry to the memory cells of a row of the array comprises circuitry for simultaneously writing data from the at least one latch to memory cells in a plurality of columns of the memory array.

4. The frame buffer of claim 3 wherein the circuitry for writing the data stored in the latching circuitry to the memory cells of a row of the array comprises circuitry for writing data to columns of the array, said columns being addressable by addresses different than the addresses of the columns of the array from which the data was read to the latching circuitry.

5. The frame buffer of claim 4 wherein the circuitry for writing data to columns of the array addressable by addresses different than the addresses of the columns of the array from which the data was read to the latching circuitry comprises means for varying the column address during writing to the array.

6. The frame buffer of claim 1 wherein the circuitry for simultaneously writing data from at least one latch to memory cells in a plurality of columns of a memory array includes:

a plurality of multiplexors arranged to transfer data to columns of the array, and;

means for causing the multiplexors to select data from the at least one latch.

7. The frame buffer of claim 6 further comprising:

a bus coupled to the multiplexors, and;

means for causing the multiplexors to select data from the bus for transferring to the array.

8. A computer system comprising a processor;

a memory;

a bus coupled to said processor and said memory; and a frame buffer coupled to said bus, said frame buffer including a memory array including a plurality of planes, each of the planes including a plurality of rows and columns of memory cells;

circuitry for accessing the array;

latching circuitry for storing data defining a plurality of pixel values;

circuitry for simultaneously reading in parallel, from the array, data defining a portion of a row of pixels, and for storing the data in the latching circuitry, said portion of a row corresponding to a predetermined number of adjacent columns of the memory array; and circuitry for writing the data stored in the latching circuitry to the memory cells of a row of the array, wherein the time required to read and write the data, defining said portion of a row of pixels corresponding to a predetermined number of adjacent columns of said memory array, to and from the latching circuitry is at least one order of magnitude less than the total time required to read and write data representing individual pixels by using the system bus a number of times equal to the number of columns included in said portion of a row of pixels.

9. The computer system of claim 8 wherein the latching circuitry comprises at least one latch for storing data defining pixels in a portion of a row of a display, and the circuitry for simultaneously reading from the array data defining a plurality of pixels and for storing the data in the latching circuitry comprises circuitry for simultaneously reading parallel data from a plurality of columns and a plurality of planes of a memory array, and circuitry for writing the data read simultaneously to the at least one of the latch.

10. The computer system of claim 9 wherein the circuitry for writing the data stored in the latching circuitry to the memory cells of a row of the array comprises circuitry for simultaneously writing data from the at least one latch to memory cells in a plurality of columns and a plurality of planes of the memory array.

11. The computer system of claim 10 wherein the circuitry for simultaneously writing data from the at least one latch to memory cells in a plurality of columns and a plurality of planes of the memory array comprises a plurality of multiplexors, each of the multiplexors being arranged to transfer data to columns of the array, and means for causing the multiplexors to select data in the at least one latch for transferring to the array.

12. The computer system of claim 11 further comprising means for causing the multiplexors to select data on the bus for coupling to the array.

13. The frame buffer of claim 10 wherein the circuitry for writing the data stored in the latching circuitry to the memory cells of a row of the array comprises circuitry for writing data to different columns than the columns from which the data was read to the latching circuitry.

14. The computer system of claim 11 further comprising a source for providing control signals to the bus, and means for clipping data transferred to the array from the at least one latch in response to the control signals.

15. The frame buffer of claim 14 wherein the means for clipping data transferred to the array from the at least one latch in response to the control signals comprises means for disabling, in response to the control signals, the transfer of specific data to the array.

16. A frame buffer comprising:

a memory array, the memory array including a plurality of rows and columns of memory cells;

circuitry for simultaneously accessing a plurality of pixel values in the array;

busing means, internal to the frame buffer, for transferring pixel data equivalent to a row of pixels from a first position in the memory array to a second position in the memory array, the busing means including circuitry for writing data stored in the latching circuitry to the memory cells of a row of the array, said circuitry for writing including a plurality of driving devices for writing data to columns of the array; and a pixel masking storage device storing a pixel mask value simultaneously with a scrolling of data wherein a predetermined pixel mask value causes said pixel masking storage device to cause a corresponding driving device of said plurality of driving devices to be disabled such that clipping of a row of data is accomplished during the scrolling of said data.

17. The frame buffer of claim 16 wherein the busing means further comprises latching circuitry for storing data defining a row of pixels, circuitry for reading data defining a row of pixels from the array and storing the data in the latching circuitry.

18. In a frame buffer including a memory array including a plurality of planes, each of the planes including a plurality of rows and columns of memory cells, said frame buffer including circuitry for accessing the array and latching circuitry for storing data defining a row of pixels, a method for transferring rows of pixel data from a first row to a second row, the method comprising the steps of:

transferring pixel data equivalent to a row of pixels from a first row of the memory array to said latching circuitry, said data equivalent to a row of pixel being transferred simultaneously in sequences of row portions corresponding to a predetermined number of adjacent columns of the memory array, writing pixel data stored in the latching circuitry to the memory cells of a second row of the array, said data stored in the latching circuitry being simultaneously written to the memory cells of the second row of the array in sequences of row portions corresponding to a predetermined number of adjacent columns of the memory array; and storing a pixel mask value in a pixel masking storage device simultaneously with a scrolling of data wherein a predetermined pixel mask value causes said pixel masking storage device to cause a corresponding driving device of a plurality of driving devices to be disabled such that clipping of a row of data is accomplished during the scrolling of said data.

* * * * *

UNITED STATES PATENT AND TRADEMARK OFFICE

CERTIFICATE OF CORRECTION

PATENT NO. : 5,805,133
DATED : September 8, 1998
INVENTOR(S) : Priem et al.

It is certified that error appears in the above-identified patent and that said Letters Patent is hereby corrected as shown below:

Title page,
Item [21], application number, delete "755,037" and insert -- 08/755,037 --.

Signed and Sealed this

Fourteenth Day of May, 2002

*Attest:*

*Attesting Officer*

JAMES E. ROGAN
*Director of the United States Patent and Trademark Office*